US007808180B2

(12) United States Patent
Haacke et al.

(10) Patent No.: US 7,808,180 B2
(45) Date of Patent: Oct. 5, 2010

(54) THORIUM-FREE ELECTRODE WITH IMPROVED COLOR STABILITY

(75) Inventors: Michael Haacke, Aachen (DE); Francis Martin Jozef Deprez, Kuringen (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 594 days.

(21) Appl. No.: 10/557,685

(22) PCT Filed: May 25, 2004

(86) PCT No.: PCT/IB2004/050769

§ 371 (c)(1), (2), (4) Date: Mar. 19, 2007

(87) PCT Pub. No.: WO2004/105082

PCT Pub. Date: Dec. 2, 2004

(65) Prior Publication Data

US 2007/0182332 A1 Aug. 9, 2007

(30) Foreign Application Priority Data

May 26, 2003 (EP) ..... 03101517
Oct. 16, 2003 (EP) ..... 03103831

(51) Int. Cl.
*H01H 61/04* (2006.01)

(52) U.S. Cl. ..... 313/633; 313/574

(58) Field of Classification Search ..... 313/633, 313/566, 622, 247, 350, 491
See application file for complete search history.

(56) References Cited

U.S. PATENT DOCUMENTS 3,067,357 A * 12/1962 Fridrich ..... 313/633
4,210,840 A 7/1980 Bhalla
5,041,041 A 8/1991 Passmore et al.
5,357,167 A * 10/1994 Mathews et al. ..... 313/632
6,211,615 B1 * 4/2001 Altmann et al. ..... 313/631
6,218,025 B1 4/2001 Fromm et al.
6,437,509 B1 * 8/2002 Eggers ..... 313/633
6,705,914 B2 * 3/2004 Tsutatani et al. ..... 445/50
7,075,232 B2 * 7/2006 Maseki et al. ..... 313/512
2003/0020394 A1 * 1/2003 Kitahara et al. ..... 313/491
2003/0168980 A1 * 9/2003 Hataoka et al. ..... 313/623
2003/0189408 A1 * 10/2003 Lapatovich et al. ..... 313/637

FOREIGN PATENT DOCUMENTS

EP 1063681 A2 12/2000
EP 1148534 A1 10/2001
GB 2031645 A 4/1980
JP 04277436 A 10/1992
JP 06089699 A 3/1994

(Continued)

*Primary Examiner*—Ashok Patel

(57) ABSTRACT

An electrode includes thorium as a minor component for a high-pressure discharge lamp, where the electrode rod is free of thorium/thorium oxide, or comprises thorium/thorium oxide, as a minor constituent. A covering member made of refractory metal, free of thorium/thorium oxide, is circumference coated on the electrode rod in the vicinity of the discharge side tip. The entire surface of the electrode rod is completely coated over the range where the covering member extends. The electrode rod tip of the electrode rod is not, or at least partly, coated with the covering member. The part of the electrode tip, which is not coated by the covering member, is free of thorium/thorium oxide.

18 Claims, 3 Drawing Sheets

FOREIGN PATENT DOCUMENTS

| | | | |
|---|---|---|---|
| JP | 10092377 | A | 4/1998 |
| JP | 2002083538 | A | 3/2002 |
| JP | 2002245965 | A | 8/2002 |
| WO | 9933091 | A1 | 7/1999 |
| WO | WO 9933091 | A1 * | 7/1999 |
| WO | 03075310 | A1 | 9/2003 |
| WO | 2004105082 | A2 | 12/2004 |
| WO | 2008122912 | A2 | 10/2008 |

* cited by examiner

THORIUM-FREE ELECTRODE WITH IMPROVED COLOR STABILITY

The present invention relates to an electrode comprising thorium as a minor component, a high pressure discharge lamp comprising said electrodes and a method of manufacturing therefore.

Electrodes commercially used for HID lamps include a thoriated tungsten electrode having the form of a coil. Various attempts have been made to improve the electrode design but there is still the need of further improvements.

EP-A1 1 148 534 discloses a high pressure mercury discharge lamp which achieves a long life of at least 3000 hours and in which variations in lamp characteristics are suppressed. This high-pressure discharge lamp comprises an electrode having a coil shape and being made of refractory metal. The refractory metal is applied on a discharge side tip of the electrode rod so as to cover a circumference of the electrode rod in a vicinity of the discharge side tip. The discharge side tip on which the covering member is applied is welded into a semi-sphere by intermittently heat fusing the discharge side tip according, for instance, to arc discharge or laser irradiation. However, contrary to the present invention the coil shape covering member is not laser melted on the electrode rod in such a manner that practically no visible internal cavities or unmelted ranges remains at least between the electrode rod and the coil since the coil is partially connected only on the electrode rod as well as the individual windings of the coil are not melted split-free to each. Thus, the electrode of EP-A1 1 148 534 posses an inferior heat conductivity as well as an increased danger of back burning or melt back of said electrode which leads for example to an increased release of thorium. Further, it is not disclosed in EP-A1 1 148 534 that at least the coil shape covering member as well as the electrode tip are thorium free.

GB-A 2 031 645 discloses an electrode without alkaline earth electron-emissive material for a miniature high pressure metal halide mercury lamp having a volume not exceeding 1 cc and a discharge current not exceeding 1 ampere comprises a slender tungsten shank with a few secondary turns of mandrel-less coiled-coil overwind thereon and preferably a balled distal end. The shank diameter is chosen in the range of 5 to 15 mils and above the size where melt-back starts at the intended lamp current, and the overwind is made of primary wire not exceeding 3 mils originally wound on a primary mandrel of 3 to 7 mils, subsequently removed. In contrast of the present invention the coil shape covering member is not laser melted on the electrode rod in such a manner that practically no visible internal cavities or unmelted ranges remains since the coil is partially connected only on the electrode rod. Rather the individual windings of the coil are not melted split-free to each. Thus, the electrode of GB-A 2 031 645 posses an inferior heat conductivity as well as an increased danger of back burning or melt back of said electrode which leads for example to an increased release of thorium.

In general, the thermal stress both during run up and steady state operation conditions of a high pressure mercury-free xenon discharge lamp is increased compared to high pressure mercury containing discharge lamps. Tungsten and/or rhenium which forms the electrode melts and disperses, the electrode tip becomes deformed and wears due to the temperature of the electrode tip increasing excessively, while the dispersed tungsten and/or rhenium is deposited on the inner surface of the light-emitting tube, causing blackening. This blackening of the inner surface of the light-emitting tube causes premature degradation of light flux.

In up-to-date HID-lamps (particularly Hg-free HID lamps), there is a danger that a high colour shift over lifetime occurs. This is especially the danger for lamps, which contain thoriumoxide, since then e.g. via the reaction $$3ThO_2+4ScI_3 \Rightarrow 3ThI_4+2ScO_3,$$

a color shift of the lamp is induced. However, a stable colour maintenance is an important quality feature of today's HID lamps.

Due to the thermal stress electrode rods comprising thorium as a minor component for example with a thickness of 250 μm have the drawback of an increased electrode back burning or melt back which leads to accelerate crystallisation and to inferior light flux [lumen] maintenance, colour stability and dramatically reduced life time. Whereon the use of electrode rods comprising thorium as a minor component with an increased thickness to easily withstands the thermal stress have the drawback due to the higher thermal load of such an electrode that the discharge bulb becomes cracks at the position where the electrode is gas tight sealed with the discharge bulb.

The object of the present invention is to avoid the disadvantages mentioned above and to provide a tungsten and/or rhenium electrode comprising as a minor amount thorium or is free of thorium, a high pressure discharge lamp and a manufacturing method therefore which achieves desirably a life of at least 1500 hrs, whereby the high pressure discharge lamp exhibits in particular an improved light flux [lumen] maintenance, reduced scandium loss, improved colour stability, reduced crystallisation as well as a diminished back burning or melt back of the electrodes.

It is a further and primary object of the present invention to provide an electrode that meets the demands in the field and that is thorium-free, preferably thorium oxide, thus significantly reducing colour shift in the lamp. This goes especially for automotive HID-Lamps.

The above-described objective can be achieved by at least one electrode for a high pressure discharge lamp, whereby the electrode and/or the electrode tip is free of thorium, preferably thorium oxide, or comprises thorium, preferably thorium oxide, as a minor constituent, characterized in that the lamp has a color shift of ΔX (difference colour point to 15 hrs) at 500 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 500 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 1000 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 750 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 1750 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 2000 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 2250 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 2500 hrs. of ≦|15|, preferably of ≦|12|, preferably of ≦|10|, preferably of ≦|8|, more preferably of ≦|5|, more preferably of ≦|3|, and most preferred of ≦|2|.

The measurement method of the ΔX and ΔY—Values as well as other measurement methods for lamp characteristics can be obtained out of the DIN R 99, which is incorporated by reference.

The above-described objective can be furthermore achieved by at least on electrode for a high pressure discharge lamp, at least one electrode rod being made of a refractory metal material as a main constituent, whereby

- the electrode rod is free of thorium, preferably thorium oxide, or comprises thorium, preferably thorium oxide, as a minor constituent,
- a covering member made of refractory metal, free of thorium, preferably thorium oxide, is circumference coated on said electrode rod in a vicinity of the discharge side tip, whereby the entire surface of the electrode rod is completely coated over the range the covering member extends,
- the electrode rod tip of said electrode rod is not or at least partly coated with said covering member,
- at least the part of the electrode tip of said electrode rod which is not coated by said covering member being free of thorium, preferably thorium oxide,
- optional the electrode tip is formed into a ball like shape or semi-sphere electrode tip, whereby the covering member is circumference split free joint with said formed electrode tip.

This above-described lamp has preferably also a color shift of ΔX (difference colour point to 15 hrs) at 500 hrs. of is ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 500 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 1000 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 750 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 1750 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 2000 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔX (difference colour point to 15 hrs) at 2250 hrs. of ≦|15|, preferably of ≦|12|, preferably of ≦|10|, preferably of ≦|8|, more preferably of ≦|5|, more preferably of ≦|3|, and most preferred of ≦|1|, and/or a color shift of ΔY (difference colour point to 15 hrs) at 2500 hrs. of ≦|15|, preferably of ≦|12|, preferably of ≦|10|, preferably of ≦|8|, more preferably of ≦|5|, more preferably of ≦|3|, and most preferred of ≦|2|.

The covering member is preferably heated up, e.g. thermally heated, and then heat coated on the electrode rod. In a preferred embodiment of the present invention the covering member is heated up to its softening point or melted and then coated on the electrode rod. More preferred, the covering member is coated by means of laser melting on the electrode rod.

The electrode tip is preferably heat formed, into a ball like shape or semi-sphere electrode tip, whereby electrode tip is preferably heated up to its softening point or melted and then formed. More preferred the electrode tip is formed by means of laser melting into a ball like shape or semi-sphere.

If the covering member comprises traces of thorium and/or the electrode is not completely covered by the covering member, the thermal load of the covering member and/or the electrode tip during the heat step should be adjusted high enough so that all or mostly all of the thorium contained in the covering member and/or the electrode tip can be thermally removed.

Preferably, the electrode rod comprises as main component tungsten and/or rhenium, most preferred a tungsten rod free of thorium, preferably thorium oxide, which is doped with potassium (K), silicium (Si) and/or aluminum (Al).

The covering member can be made of a refractory metal selected from the group comprising tungsten, tungsten doped with potassium (K), silicium (Si) and/or aluminum (Al), rhenium and/or rhenium doped with potassium (K)), silicium (Si) and/or aluminum (Al).

According to one embodiment of the present invention an electrode can be manufactured whereby the electrode tip of an electrode rod free of thorium or comprising thorium as a minor amount, such as $ThO_2$, is formed by means of laser-melt into a ball like shape or semi-sphere electrode tip, whereby the ball like shape or semi-sphere electrode tip becomes free of thorium. The bulk form of said ball like shape or semi-sphere electrode tip protects the electrode tip for back burning or melt back. Subsequently, the electrode rod is by means of laser melting circulating coated with the covering member. However, the covering member can be laser melted circumference on a discharge side tip of said electrode rod in a vicinity of the discharge side tip before or during the electrode tip is formed by means of laser-melt to a ball like shape or semi-sphere electrode tip.

According to a further preferred embodiment of the present invention an electrode can be manufactured whereby the covering member is laser melted circumference on a discharge side tip of an electrode rod free of thorium or comprises thorium as a minor constituent in a vicinity of the discharge side tip without that the electrode tip is laser-melt to a ball like shape or semi-sphere electrode tip. In such a case the electrode tip is at least partly covered by the laser melted covering member, if the electrode rod tip is thorium free. More preferably the electrode rod tip is completely covered by the laser melted covering member.

The term "thorium" as used in the present invention comprises thorium oxide such as $ThO_2$. The term "thorium free" means that neither thorium as element or as composition, such as thorium oxide, is contained. However, it is possible that at most traces of thorium close at the detection limit are contained.

It is a further primary object of the present invention to prevent that ScJ3 of the filling will be reduced by reaction with compounds of thorium. By doing so, the colour shift of the lamp can be reduced significantly.

The electrode of the present invention comprises an electrode rod with an electrode tip and a covering member, whereby the covering member surrounds the electrode rod to avoid back burning or melt back. The electrode rod with electrode tip used for the production of the electrode of the present invention comprises preferably thoriated tungsten and/or rhenium. It is also possible that the electrode rod comprises tungsten free of thorium and/or doped tungsten, whereby the tungsten can be doped with potassium (K), silicium (Si) and/or aluminum (Al).

The electrode rod can comprise ≧0 ppm to 5 ppm thorium, preferably ≦1 ppm, more preferably ≦0.1 ppm.

By using such a nearly thoriumoxide-free electrode, the reaction

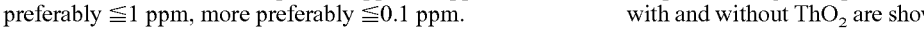

$$3ThO_2+4ScI_3 \Rightarrow 3ThI_4+2Sc_2O_3$$

can be prevented or significantly reduced, thus reducing the colour shift of the lamp.

In Table I, the colour shifts of several lamps, including lamps according to the present invention, using electrode rods with and without $ThO_2$ are shown.

TABLE I

| Electrode design | | ΔColour-coordinate | 250 hrs | 500 hrs | 750 hrs | 1000 hrs | 1500 hrs | 2000 hrs |
|---|---|---|---|---|---|---|---|---|
| 300 μm rod (with $ThO_2$) | Comparative | ΔX-Colour (to 15 hrs) | −14 | −14 | −14 | −12 | −10 | −8 |
| 300 μm rod (with $ThO_2$) | Comparative | ΔY-Colour (to 15 hrs) | −19 | −20 | −15 | −19 | −16 | −13 |
| 300 μm rod (without $ThO_2$) | Inventive | ΔX-Colour (to 15 hrs) | −4 | −3 | −3 | −3 | −1 | −5 |
| 300 μm rod (without $ThO_2$) | Inventive | ΔY-Colour (to 15 hrs) | −2 | −4 | −4 | −2 | −2 | −4 |
| 300 μm rod (with $ThO_2$) and a 380 μm x 1,4 mm tip (without $ThO_2$) | Inventive | ΔX-Colour (to 15 hrs) | −2 | −3 | −3 | −6 | −4 | −5 |
| 300 μm rod (with $ThO_2$) and a 380 μm x 1,4 mm tip (without $ThO_2$) | Inventive | ΔY-Colour (to 15 hrs) | 2 | −2 | −2 | −4 | −2 | 0 |

Table II shows the colour shifts of several lamps, including lamps according to the present invention, using electrode rods with and without $ThO_2$.

TABLE II

| Electrode Design | Delta Colour Coordinate | 250 hrs | 500 hrs | 750 hrs | 1000 hrs | 1250 hrs |
|---|---|---|---|---|---|---|
| R-Type (with pinstripe) | | | | | | |
| electode with ThO2 | ΔX (difference colour point to 15 hrs) | −14 | −14 | −17 | −14 | −10 |
| (comparative | ΔY (difference colour point to 15 hrs) | −20 | −20 | −18 | −16 | −12 |
| electrode without ThO2 | ΔX (difference colour point to 15 hrs) | −2 | −3 | −3 | −6 | −3 |
| at tip (inventive) | ΔY (difference colour point to 15 hrs) | 2 | −2 | −2 | −4 | −2 |
| electrode totally without | ΔX (difference colour point to 15 hrs) | −6 | −1 | −6 | −5 | −9 |
| ThO2 (inventive) | ΔY (difference colour point to 15 hrs) | −7 | −2 | −3 | −3 | −3 |
| S-Type (without pinstripe) | | | | | | |
| electode with ThO2 | ΔX (difference colour point to 15 hrs) | −12 | −14 | −18 | −16 | −13 |
| (comparative) | ΔY (difference colour point to 15 hrs) | 18 | −20 | −21 | −23 | −17 |
| elctrode without ThO2 | ΔX (difference colour point to 15 hrs) | −2 | −5 | −5 | −2 | −1 |
| at tip (inventive) | ΔY (difference colour point to 15 hrs) | 0 | −2 | −2 | −3 | 0 |
| electrode totally without | ΔX (difference colour point to 15 hrs) | −4 | −2 | −2 | 1 | −3 |
| ThO2 (inventive) | ΔY (difference colour point to 15 hrs) | −3 | −1 | 0 | 3 | 2 |

| Electrode Design | Delta Colour Coordinate | 1500 hrs | 1750 hrs | 2000 hrs | 2250 hrs | 2500 hrs |
|---|---|---|---|---|---|---|
| R-Type (with pinstripe) | | | | | | |
| electode with ThO2 | ΔX (difference colour point to 15 hrs) | −5 | −2 | −3 | −5 | 2 |
| (comparative | ΔY (difference colour point to 15 hrs) | −6 | −9 | −9 | −12 | −16 |
| electrode without ThO2 | ΔX (difference colour point to 15 hrs) | −2 | −1 | −5 | −6 | −4 |
| at tip (inventive) | ΔY (difference colour point to 15 hrs) | 1 | 4 | 3 | 2 | 3 |
| electrode totally without | ΔX (difference colour point to 15 hrs) | −7 | −7 | −6 | −5 | −6 |
| ThO2 (inventive) | ΔY (difference colour point to 15 hrs) | −1 | −4 | −3 | −2 | −2 |
| S-Type (without pinstripe) | | | | | | |
| electode with ThO2 | ΔX (difference colour point to 15 hrs) | −11 | −5 | −4 | −5 | 0 |
| (comparative) | ΔY (difference colour point to 15 hrs) | −13 | −7 | −6 | −7 | −9 |

TABLE II-continued

| | | | | | | |
|---|---|---|---|---|---|---|
| elctrode without ThO2 | ΔX (difference colour point to 15 hrs) | −4 | 0 | −5 | −3 | −2 |
| at tip (inventive) | ΔY (difference colour point to 15 hrs) | 2 | 4 | 3 | 4 | 3 |
| electrode totally without | ΔX (difference colour point to 15 hrs) | −4 | −5 | −4 | −2 | −3 |
| ThO2 (inventive) | ΔY (difference colour point to 15 hrs) | 0 | 2 | 1 | 2 | 3 |

It can be clearly seen, that by omitting $ThO_2$, the ΔX- and ΔY-Colour values can be significantly increased.

The laser melted electrode tip of the invention comprises preferably 0 ppm thorium, such as thorium oxide, or at most traces of thorium.

However, it is preferred that the range of the electrode where the electrode rod is coated with said covering member is free of thorium up to a layer depth of 10 μm to 150 μm, preferably up to a layer depth of 20 μm to 130 μm, more preferably up to a layer depth of 30 μm to 120 μm and most preferably up to a layer depth of 40 μm to 110 μm. Depending of the diameter of the covered electrode rod range the thorium free layer depth can be of 50 μm to 250 μm, preferably up to a layer depth of 60 μm to 225 μm, more preferably up to a layer depth of 70 μm to 200 μm and most preferably up to a layer depth of 80 μm to 170 μm.

The layer depth is measured from the upper outer surfaces of the coated electrode range to the electrode axis in a range of 50 μm to 500 μm extending from the electrode tip along the coated electrode rod range.

The release of $ThO_2$ leads to a decrease of scandium (Sc) and the sodium (Na) pressure of the ionizable filling. Thus, the light flux [lumen] maintenance, colour stability and life time is disadvantageous effected.

For the avoidance of this disadvantage it is suggested for a first alternative according to the invention a method for manufacturing an electrode comprising the steps:

a) forming an electrode tip of an electrode rod comprising thorium as a minor amount, such as $ThO_2$, by means of laser-melt to a ball like shape or semi-sphere electrode tip, whereby the ball like shape or semi-sphere electrode tip becomes free of thorium;

b) contacting a covering member made of refractory metal and free of thorium (Th) by means of laser melting circumference at said ball like shape or semi-sphere electrode tip, whereby the laser melted covering member contacts completely split-free the ball like shape or semi-sphere electrode tip so that practically no visible internal cavities or unmelted areas remains; and c) coating said covering member by means of laser melting along its entire length circumference on said electrode rod so that practically no visible internal cavities or unmelted areas between the laser melted covering member and said electrode rod remains.

According to a second alternative for manufacturing an electrode it is suggested that:

a) forming an electrode tip of an electrode rod free of thorium by means of laser-melt to a ball like shape or semi-sphere electrode tip;

b) contacting a covering member made of refractory metal and free of thorium (Th) by means of laser melting circumference at said ball like shape or semi-sphere electrode tip, whereby the laser melted covering member contacts completely split-free the ball like shape or semi-sphere electrode tip so that practically no visible internal cavities or unmelted areas remains; and c) coating said covering member by means of laser melting along its entire length circumference on said electrode rod so that practically no visible internal cavities or unmelted areas between the laser melted covering member and said electrode rod remains.

According to a third alternative for manufacturing an electrode it is suggested that:

a) placing a covering member made of refractory metal free of thorium (Th) on a thorium free electrode rod up to the electrode rod tip;

b) coating said covering member by means of laser melting along its entire length circumference on said electrode rod so that practically no visible internal cavities or unmelted areas between the laser melted covering member and said electrode rod remains.

During the laser melt process for forming the electrode tip and/or for coating the covering member circumference on the electrode rod:—the electrode rod can be rotated; and/or—the laser can be rotated around the electrode.

It is possible to use more than one laser, for example at least two or three lasers. A number of lasers can be arranged in a fixed position around the electrode rod so that the electrode rod during the laser melt step needs not to be rotated.

Preferably, the covering member is a coil which is circumference completely coated along its entire length by means of laser melt in a vicinity of the discharge side tip on the electrode rod so that the completely melted covering member shows practically no gaps, has a smooth upper surface and practically no internal cavities or unmelted areas. The smooth upper surface can have a wave like form.

During the laser melt process the covering member, such as a coil, is laser melted to a preferably homogeneous coating mass, whereby the original form of the covering member is lost completely.

An electrode rod which can be used in the present invention comprises preferably as a main component tungsten and/or rhenium and as a minor component thorium, such as thoriumoxid ($ThO_2$). In particular, an electrode rod comprising:

tungsten and being free of thorium; or potassium (K), silicium (Si) and/or aluminum (Al) doped tungsten free of thorium can be used according to the present invention, whereby potassium doped tungsten free of thorium is most preferred.

The electrode rod, based on the total weight of the electrode rod, can contain 0 weight-% to 5 weight-% thorium, preferably >0 weight-% to ≦2 weight-% thorium and more preferably ≧0.001 weight-% to ≦1 weight-% thorium. Further, the electrode rod can comprise accessory constituents selected from the group of Al, Ca, Cr, Cu, Fe, Mg, Mn, Ni, Si, Sn, Na, K, Mo and/or U. Most preferably the electrode rod is doped with potassium (K), silicium (Si) and/or aluminium (Al), whereby the potassium content of said electrode rod, based on the total weight of the electrode rod, is of ≧0 ppm to ≦500 ppm, preferably of ≧50 ppm to ≦100 ppm. The Silicium content of said electrode rod, based on the total weight of the electrode rod, can be of ≧0 ppm to ≦300 ppm and preferably of ≧50 ppm to ≦100 ppm. The Aluminum content of said electrode rod, based on the total weight of the electrode rod, can be of ≧0 ppm to ≦100 ppm and preferably of ≧10 ppm to ≦50 ppm.

All quantitative data are given in weight-% or weight ppm if not other noted.

As a way of solving the problem of lengthening the life of high pressure discharge lamps, preferably high pressure xenon mercury-free discharge lamps, it is suggested by the inventors that the electrode rod is covered by a covering member made of refractory metal free of thorium (Th), whereby the covering member is selected from the group comprising a coil, a tube, a tube with two openings at each end part or a tube with one closed end part and/or rings, whereby a wire coil is most preferred.

The range of the electrode rod coated with the laser melted covering member forms the electrode head.

The range of the electrode rod which forms the electrode head can comprise thoriated tungsten if the electrode tip is free of thorium. The tungsten can be doped with potassium (K), silicium (Si) and/or aluminum (Al), whereby potassium is preferred.

The diameter of the electrode head can be of 250 μm to 550 μm, preferably 300 μm to 500 μm and more preferably 350 μm to 450 μm.

This ensures on one hand a sufficient protection from back burning or melt back of the electrode and reduces the danger of liberating thorium.

Due to the laser melt covering member the so covered electrode rod is up to a certain layer depth $ThO_2$-free, whereby in the electrode core $ThO_2$ can still be present, if thoriated tungsten electrode is used. Consequently, back burning or melt back of the so coated electrode prevents or reduces strongly a release of thorium, such as $ThO_2$.

On the other hand the electrode is still sufficiently warmed up in order to achieve a stable electric discharge.

It has to be noted further that the electrode design according to the present invention reduces strongly back burning or melt back of the electrode over lifetime, thus an electrode deformation is prevented or reduced strongly which increases arc stability over lifetime. In other words an arc instability can be prevented or an occurrence of an arc instability is very strongly shifted to the end of the lifetime of said high pressure discharge lamp.

In order to avoid a too large heat transfer to the discharge bulb and an associated strong thermal stress, the length of the electrode can be dimensioned in such a way that the electrode range which is gas tight joint with or sandwiched between the discharge bulb is 150 μm to 400 μm, preferably 200 μm to 350 μm and more preferably 250 μm to 320 μm.

A part of the electrode range coated with the covering member can be gas tight joint with the discharge bulb. However, it is preferred that the electrode range which is coated with the covering member (=electrode head) extends inside the burner but is not joint with or sandwiched between the discharge bulb. It is preferred that the electrode part which is not covered with the covering member is gas tight sandwiched or gas tight joint with the discharge bulb end part opening.

The discharge bulb of the discharge lamp of the present invention is preferably based of quartz glass or ceramic.

Tungsten possesses a higher heat conductivity compared with rhenium. For low temperatures (~500° C.) it is about 2.9 times higher compared with rhenium and approximately 2.6 times higher compared with tungsten rhenium alloy (75%/25%).

It is preferred that at least within the range where the electrodes are sealed or pinched with the discharge bulb each electrode having a diameter of 150 μm to 400 μm, more preferred of 200 μm to 350 μm and most preferred of 250 μm to 320 μm.

The distance of the electrode rod which is not coated by a covering member up to the position where the electrode is joint or sandwiched with the inner discharge bulb of the burner can be of 0 μm to 5000 μm, preferably 10 μm to 3000 μm, more preferably 50 μm to 2000 μm and most preferably 60 μm to 1500 μm.

The covering member is laser melted circumference on the electrode rod in a vicinity of the discharge side tip. It is important that the covering member is laser melted on the electrode rod such that practically no remaining defects such as internal cavities or unmelted areas are obtained. In case the covering member used is a coil after it is laser melted, the coil rings have been melted together so that an upper smooth surface is obtained and between the coated electrode and the laser melted coil practically no internal cavities or unmelted areas remain. However, the upper surface of the laser melted covering member can have a wavy surface.

Again, it is preferred that no or practically no visible internal cavities or unmelted areas remain of the laser melted covering member, especially between the melted covering member and the electrode rod range covered therewith. However, if smaller internal cavities formed these internal cavities have a diameter of $\geqq 0$ μm and $\leqq 100$ μm, preferably $\leqq 10$ μm and more preferably $\leqq 1$ μm.

To avoid back burning or melt back of the electrode the electrode head, i.e. the electrode range of the electrode rod coated with the laser melted covering member, can have a thickness of at least 250 μm to about 550 μm, preferably of between 300 μm to 500 μm and more preferably of between 350 μm to 450 μm.

It is preferred that the melted covering member extends parallel along the electrode up to the electrode tip, whereby the electrode tip is not or at least partly or completely coated with the melted covering member.

Further to avoid back burning or melt back of the electrode rod which has the danger of releasing $ThO_2$ it is preferred that the laser melted covering member or electrode head has a lengthen of at least 300 μm to about 1500 μm, preferably of between 500 μm to 1300 μm and more preferably of between 800 μm to 1100 μm.

In case the thorium free electrode tip has a ball like or semi-sphere form, such an electrode tip can have a length of at least 250 μm to about 550 μm, preferably of between 300 μm to 500 μm and more preferably of between 350 μm to 450 μm.

Another object of the present invention concerns a high pressure discharge lamp comprising a sealed discharge bulb containing an ionisable filling including an inert starting gas and according to the present invention two electrodes in opposition.

The distance between the two opposed electrode tips is of at least 2.0 mm to about 5.0 mm, preferably of between 3.0 mm to 4.5 mm and more preferably of between 3.5 mm to 4.0 mm.

The high pressure discharge lamp is most preferably a high pressure mercury-free discharge lamp and said inert starting gas is preferably xenon.

Preferably, a gas tight sealed discharge bulb of a high pressure discharge lamp of the present invention has—an inner diameter in the range of 2.0 mm to 3.0 mm, and/or,—an inner volume in the range of 15 μl to 40 μl, and/or,—a filling pressure at room temperature in the range of 5 bar to 20 bar.

The discharge bulb preferably can have any suitable form. However, the inner contour of the discharge bulb can be cylindrically, elliptically or asymmetrically.

The ionisable filling of the burner inside the discharge bulb comprises at least one of the components selected from the group of $ScI_3$, NaI, InJ, ZnJ2, TlJ, $ThJ_4$, AlBr3, InBr, HfBr4, AlJ3, MgJ2, CeJ3, CsJ and/or DyI3. Preferably, the ionisable filling does not contain mercury.

According to one embodiment to the present invention the mercury-free ionisable filling, based on the total weight of the ionisable filling, comprises the following components:

0-4 weight.-% $ThJ_4$, 10-60 weight.-% $ScI_3$, preferably 10-40% weight % of $ScI_3$ 40-80 weight.-% NaI, 0-5 weight.-% InJ, 0-20 weight.-% ZnJ2.

The components of the ionisable filling are selected such that the total amount does not exceed 100 weight-%.

According to another embodiment to the present invention the mercury-free ionisable filling, based on the total weight of the ionisable filling, comprises at least: 0-4 weight.-% $ThJ_4$, 10-60 weight.-% $ScI_3$, preferably 10-40% weight % of $ScI_3$ A high pressure discharge lamp according to the present invention, in particular a high pressure mercury-free xenon discharge lamp, can have a light flux [lumen] maintenance at a life time of 200 hours of ≧92%; and/or a light flux [lumen] maintenance at a life time of 500 hours of ≧90%; and/or a light flux [lumen] maintenance at a life time of 1000 hours of ≧85%.

These and other objects, advantages and features of the invention will become apparent from the following drawings which illustrate an embodiment of the invention. In the drawings:

FIG. 1 shows an electrode rod (1) for a high pressure discharge lamp with a coil (2) surrounding said electrode rod (1) in a vicinity of the discharge side tip (3). As shown in FIG. 1, the coil (2) does not extend over the electrode tip (3) of said electrode rod (1).

Figure 1:
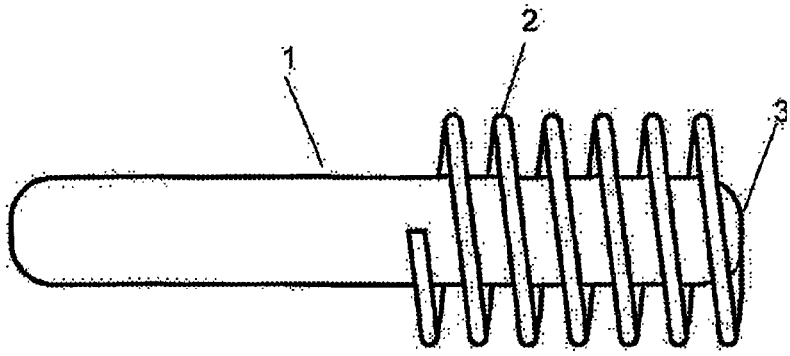
FIG. 1 shows an example of an electrode for a high pressure discharge lamp with a coil surrounding said electrode rod in a vicinity of the discharge side tip.
Figure 2:
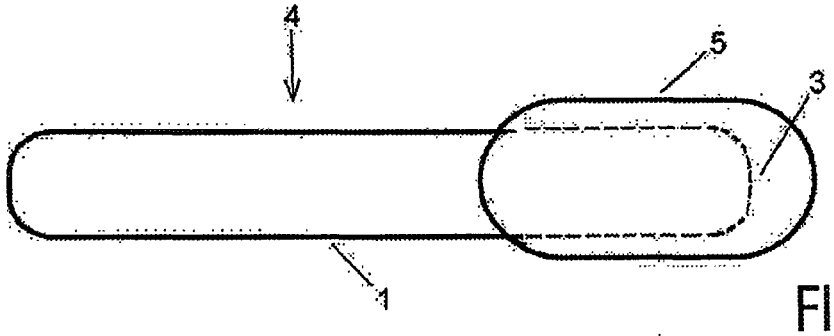
FIG. 2 shows and example of an electrode of the present invention after a coil is laser melted circumference of the electrode rod in a vicinity of the discharge side tip.

FIG. 2 shows the electrode (4) of FIG. 1 for a high pressure discharge lamp with a laser melted coil (5) surrounding said electrode rod (1) in a vicinity of the discharge side tip (3). As shown in FIG. 2 the coil member rings (2) has been melted together (5) so that an upper surface is obtained having practically no visible internal cavities. The laser melted coil (5) becomes a uniform melted form having practically no unmelted areas. The upper surface of the melted covering member (5) has a smooth upper surface. It is further shown in FIG. 2 that the electrode tip (3) of said electrode rod (1) is completely covered by the laser melted coil (5) (=melted covering member).

Figure 3:
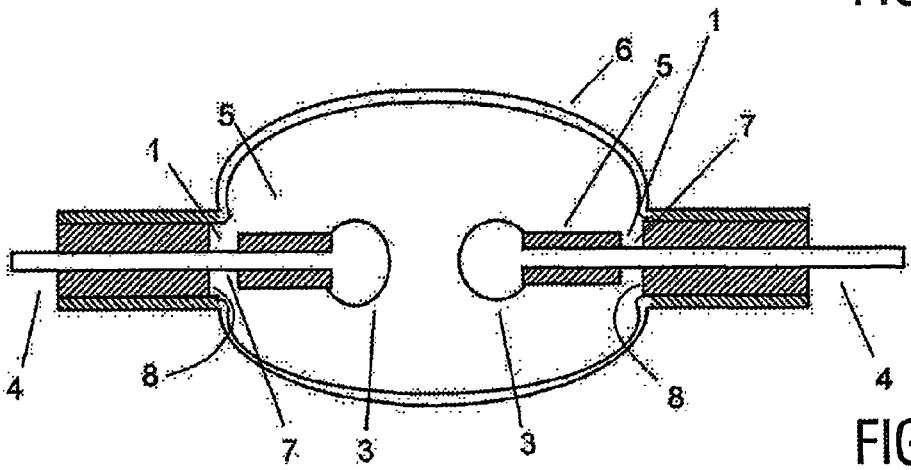
FIG. 3 shows a partially cut away view showing the structure of a gas tight sealed discharge bulb with two opposing electrodes according to the present invention whereby the electrode tip of said electrode rod is not covered by a covering member.

FIG. 3 is a partially cut away view showing the structure of a gas tight sealed discharge bulb (6) with to opposing electrodes (4) of the present invention. As shown in FIG. 3 the electrode tip (3) of said electrode rod (1) is not covered by a covering member (5) but formed by means of laser melting to a ball like shape (3). Further, FIG. 3 shows that the electrode rod (1) is not fully covered parallel along the electrode axis (7) up to the inner discharge bulb surface (8).

Figure 4:
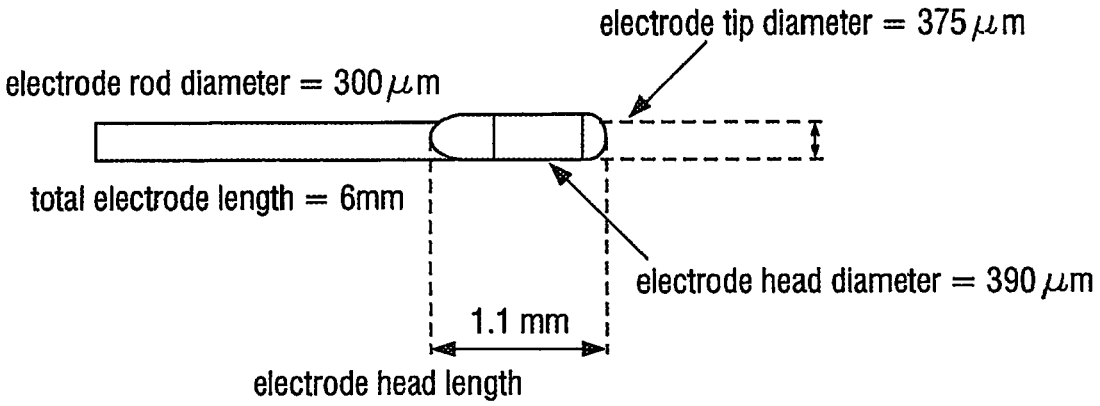
FIG. 4 shows an electrode design of the present invention.

FIG. 4 shows an example of a preferred electrode design of the present invention. As shown in FIG. 4 the electrode rod has a total length of 6 mm, an electrode rod diameter of 300 μm. The shaft diameter of the coated electrode rod with laser melted covering member is 390 μm and the length of the laser melted covering member is 1.1 mm.

Figure 5:
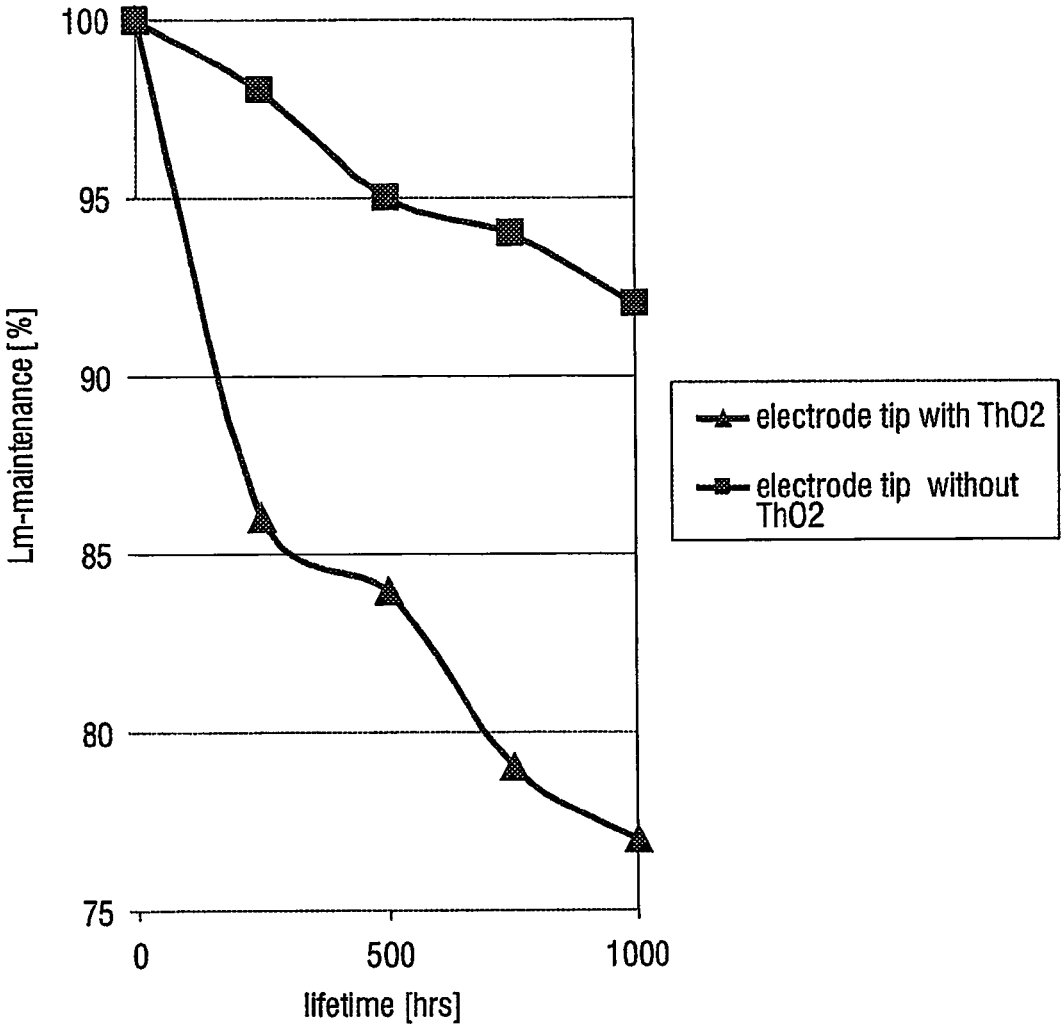
FIG. 5 is a drawing showing variations in light flux [lumen] maintaining rate over life time of high pressure discharge lamps of the present invention.

FIG. 5 showing variations in light flux [lumen] maintaining rate over life time of high pressure mercury-free xenon discharge lamps of the present invention compared to the same high pressure discharge lamps with thoriated tungsten electrode, except that the electrode is not coated by a covering member. Thus, FIG. 5 clearly demonstrates that lengthening of the life of lamps of the present invention, comprising colour stabilisation, light flux [lumen] maintaining rate etc., is achieved when coating the electrode with a thorium free covering member which suppresses liberation of thorium. The thorium free electrode tip is obtained for example by laser melting the thorium free covering member on the electrode rod. The thermal load of the electrode tip during the laser melting step is high enough so that all or mostly all of the thorium contained in the electrode tip can be thermally removed.

Lamps of the present invention can be preferably used in the field of automotive such as head lamps.

The invention will further be illustrated by a specific embodiment of example 1 of the invention.

EXAMPLE 1

A high pressure mercury-free xenon discharge lamp is provided with a discharge bulb, two electrodes placed so as to be in opposition with a distance of 3.7 mm between the two electrodes. The electrode rod of thoriated tungsten 1 wt.-% ThO2 has a total length of 6 mm, an electrode rod diameter of 300 μm. The shaft diameter of the coated electrode rod with laser melted covering member is 390 μm and the length of the laser melted covering member is 1.1 mm. The electrode range coated with the covering member (electrode head) extends inside the burner and is not joint or sandwiched with the discharge bulb. The volume of the discharge bulb of the discharge lamp is 22 μl and the inner gas pressure at room temperature is 9.5 bar. The electrode is coated with a laser melted coil. The coil is made of tungsten doped with potassium and free of thorium. The laser melted coil has a melted form with a smooth upper surface whereby the melted coil has practically no unmelted areas. The electrode head, which is formed of the electrode rod range which is coated with the melted coil (electrode head) has a diameter of 390 μm and a lengths of 1.1 mm.

The variations in light flux [lumen] maintaining rate over life time of the high pressure discharge lamp of example 1 is shown in FIG. 5.

The invention claimed is:

1. An electrode for a high pressure discharge lamp comprising:

an electrode rod having an electrode tip, wherein the electrode rod includes thorium; and a coil of material which is free of thorium and thorium oxide;

wherein the electrode rod has a first part covered with the material, the first part having a first diameter which is smaller than a tip diameter of the electrode tip, and wherein the electrode rod has a second part not covered with the material, the second part having a second diameter which is smaller than the first diameter, the second part being located away from the electrode tip, and the first part being located near the electrode tip between the second part and the electrode tip, wherein the coil has individual windings located around the electrode tip, the individual windings being melted to remove the thorium from the electrode tip and to form a continuous coating over the electrode tip so that the individual windings are melted split-free to each other to form a continuous surface with no visible internal cavities remaining between the electrode rod and the coil; and wherein the lamp has a color shift of ΔX (difference colour point to 15 hours) at 500 hours of ≦|15|, and at 1000 hours of ≦|15|, a color shift of ΔY (difference colour point to 15 hours) at 750 hours of ≦|15|, the color shift of ΔX at 1750 hours being ≦|15|, the color shift of ΔY at 2000 hours being ≦|15|, and the color shift of ΔX at 2250 hours being ≦|15|.

2. The electrode of claim 1, wherein the electrode rod is made of a material having tungsten doped with potassium (K), silicium (Si) and/or aluminum (Al), and wherein the potassium content of said electrode rod, based on the total weight of the electrode rod, is of ≧0 ppm to ≦500 ppm, and the Silicium content of said electrode rod, based on the total weight of the electrode rod, is of ≧0 ppm to ≦300 ppm, and the Aluminum content of said electrode rod, based on the total weight of the electrode rod, is of ≧0 ppm to ≦100 ppm.

3. The electrode of claim 1, wherein the electrode tip including the coating has a ball like or semi-sphere form and has a length of at least 250 μm to about 550 μm.

4. The electrode of claim 1, wherein the continuous surface of the coating has a wave like form.

5. The electrode of claim 1, wherein the electrode tip covered by the coating is free of thorium up to a depth of 10 μm to 550 μm.

6. A high-pressure discharge lamp comprising a sealed discharge bulb containing an ionisable filling including an inert starting gas and at least two electrodes according to claim 1, wherein said high-pressure discharge lamp is a high-pressure mercury-free discharge lamp and said inert starting gas is xenon.

7. A lighting device containing at least one mercury-free high-pressure discharge lamp according to claim 6, wherein the lighting device is a reflection headlight, a projection headlight, projector and/or a lamp for the general lighting purposes.

8. An electrode for a high pressure discharge lamp comprising:

an electrode rod having an electrode tip, wherein the electrode rod includes thorium; and a coil of material which is free of thorium and thorium oxide;

wherein the electrode rod has a first part covered with the material, the first part having a first diameter which is smaller than a tip diameter of the electrode tip, and wherein the electrode rod has a second part not covered with the material, the second part having a second diameter which is smaller than the first diameter, the second part being located away from the electrode tip, and the first part being located near the electrode tip between the second part and the electrode tip, wherein the coil has individual windings located around the electrode tip, the individual windings being laser melted to remove the thorium from the electrode tip and to form a continuous coating over the electrode tip so that the individual windings are melted split-free to each other to form a continuous surface with no visible internal cavities remaining between the electrode rod and the coil.

9. The electrode of claim 8, wherein the lamp has a color shift of ΔX (difference colour point to 15 hours) at 500 hours of ≦|15|, and at 1000 hours of ≦|15|, a color shift of ΔY (difference colour point to 15 hours) at 750 hours of ≦|15|, the color shift of ΔX at 1750 hours being ≦|15|, the color shift of ΔY at 2000 hours being ≦|15|, and the color shift of ΔX at 2250 hours being ≦|15|.

10. The electrode of claim 8, wherein the continuous surface of the coating has a wave like form.

11. The electrode of claim 8, wherein the electrode tip covered by the coating is free of thorium up to a depth of 10 μm to 550 μm.

12. The electrode of claim 8, wherein the electrode tip covered by the coating has a thickness of 250 μm to 550 μm.

13. The electrode of claim 8, wherein the electrode tip covered by the coating has a length of 300 μm to 1500 μm.

14. A method of forming an electrode for lamp comprising the acts of:

providing an electrode rod having an electrode tip, wherein the electrode rod includes thorium;

providing around the electrode tip a coil of material which is free of thorium and thorium oxide;

laser melting individual windings of the coil to remove the thorium from the electrode tip and to form a continuous coating over the electrode tip by melting the individual to each other to form a continuous surface with no visible internal cavities remaining between the electrode rod and the coil; and covering a first part of the electrode rod with the material, wherein the first part has a first diameter which is smaller than a tip diameter of the electrode tip, and wherein the electrode rod has a second part not covered with the material, the second part having a second diameter which is smaller than the first diameter, the second part being located away from the electrode tip, and the first part being located near the electrode tip between the second part and the electrode tip.

15. The method of claim 14, further comprising the act of coating a first part of the electrode rod with the material up to the electrode tip by laser melting, wherein a second part of the electrode rod is not covered by the material, the second part being between the first part and an inner surface of a discharge bulb that includes the electrode.

16. The method of claim 14, wherein the electrode tip covered by the coating is free of thorium up to a depth of 10 μm to 550 μm.

17. The method of claim 14, wherein the electrode tip covered by the coating has a thickness of 250 μm to 550 μm.

18. The method of claim 14, wherein the electrode tip covered by the coating has a length of 300 μm to 1500 μm.

* * * * *